US007003995B2

(12) United States Patent
Ghiran et al.

(10) Patent No.: US 7,003,995 B2
(45) Date of Patent: Feb. 28, 2006

(54) HYDROTAPPING POWER UNIT

(75) Inventors: Mircea M. Ghiran, Lake Orion, MI (US); Spyros P. Mellas, Waterford, MI (US); David R. Jensen, Swartz Creek, MI (US); Paul D. Larsen, Fenton, MI (US)

(73) Assignee: General Motors Corporation, Detroit, MI (US)

( * ) Notice: Subject to any disclaimer, the term of this patent is extended or adjusted under 35 U.S.C. 154(b) by 137 days.

(21) Appl. No.: 10/799,068

(22) Filed: Mar. 12, 2004

(65) Prior Publication Data

US 2005/0199029 A1 Sep. 15, 2005

(51) Int. Cl.
*B21D 22/00* (2006.01)

(52) U.S. Cl. ..... 72/55; 72/71; 72/325; 72/453.01; 72/432

(58) Field of Classification Search ..... 72/55, 72/58, 61, 71, 324, 325, 370.27, 431, 432, 72/453.01, 453.02; 83/54
See application file for complete search history.

(56) References Cited

U.S. PATENT DOCUMENTS 3,302,493 A * 2/1967 Hulslander et al. ..... 72/71
3,812,698 A * 5/1974 Stock ..... 72/71
3,837,121 A * 9/1974 Schimer ..... 451/160
4,414,835 A * 11/1983 Larikka ..... 72/71
4,534,682 A * 8/1985 Carlson ..... 408/14
5,398,533 A 3/1995 Shimanovski et al. ..... 72/55
5,666,840 A 9/1997 Shah et al. ..... 72/55
6,073,708 A * 6/2000 Brown et al. ..... 175/93
6,427,508 B1 * 8/2002 Lehto et al. ..... 72/71
6,915,672 B1 * 7/2005 Ghiran et al. ..... 72/55

OTHER PUBLICATIONS

U.S. Appl. No. 10/690,100, filed Oct. 21, 2003.

* cited by examiner

*Primary Examiner*—Ed Tolan
(74) *Attorney, Agent, or Firm*—Laura C. Hargitt

(57) ABSTRACT

A hydrotapping power unit is disclosed that is operable to hold a hydrotapping tool in a home position adjacent a part while the latter is being hydroformed in a die cavity, to then advance the tool to pierce a hole in the hydroformed part while the part remains in the die cavity and under pressure and then continue to advance the tool to inwardly extrude the part about the hole, to then further advance while also rotating the tool at a feed rate equal to the thread pitch of the tool to thereby form a thread in the pierced hole, and finally retract while also rotating the tool but in the reverse direction and at the same feed rate to release the tool from the threaded hole. The power unit for performing these operations includes a linearly moveable shaft for holding the tool, a powered device for rotating the shaft, another powered device connected to the shaft by a lead screw connection having a thread pitch equal to that of the tool, and a third powered device that is adapted to intercept and prevent shock loading on the tool from the piercing operation and thereby on the shaft from reaching the lead screw connection.

12 Claims, 7 Drawing Sheets

HYDROTAPPING POWER UNIT

TECHNICAL FIELD

This invention relates to a power unit for powering a hole-piercing/extruding/thread-forming tool and more particularly to a power unit for powering such a tool in a prescribed manner so as to form a relatively deep threaded hole in a hydroformed part while the part remains in the hydroforming dies.

BACKGROUND OF THE INVENTION

In U.S. patent application Ser. No. 10/690,100 now U.S. Pat. No. 6,931,901 filed Oct. 21, 2003 and entitled "METHOD AND APPARATUS FOR FORMING A THREADED HOLE IN A HYDROFORMED PART" and assigned to the assignee of this invention, there is disclosed a tool for piercing a hole in a hydroformed part and then forming a thread in the hole while the part remains in the hydroforming dies following its hydroforming. Wherein the tool which is referred to as a hydrotapping tool (1) first pierces the hole in a tool advancing tool operation while the hydroforming pressure is maintained, (2) then extrudes the wall about the hole in a continued tool advancing operation to thereby deepen the hole, (3) then sizes the deepened hole in a continued tool advancing operation, (4) then in a turning and advancing tool operation forms a thread in the hole in a metal displacing operation, and (5) then is retracted from the threaded hole while being rotated in the opposite direction in order to release the tool from the threaded hole. And wherein in the thread forming operation, the tool must be fed at a feed rate equal to that of the thread-forming portion of the tool and also at this same feed rate but in the opposite direction in order to retract the tool from the threaded hole without wiping out the formed thread.

While a power arrangement suitably adapted to powering the tool as disclosed in the above-mentioned U.S. patent application Ser. No. 10/690,100 now U.S. Pat. No. 6,931,901 would be satisfactory in many cases, there remains a need for a rugged and highly reliable power unit for powering such a tool in meeting the demands of high volume production. Such as for example the hydroformed part for mass-produced motor vehicles. Wherein one or more threaded holes are required in the hydroformed part and each threaded hole must be accurately located and the thread formed therein made strong and precise and all without producing metal cuttings that could enter the part and contaminate the hydroforming apparatus. Such as would be the case with a drilling operation followed by an extruding operation and then a threading operation using a thread cutting tap in order to form the required threaded hole.

SUMMARY OF THE INVENTION

The present invention meets the goals of sufficiently and efficiently powering such a hydroforming tap with a hydrotapping power unit comprising a powered drive mechanism operable to (1) hold a hole-piecing/extruding/thread-forming tool in a home holding position adjacent a part while the latter is being hydroformed in a die cavity, (2) then advance the tool to pierce a hole in a hydroformed part while the part remains in the die cavity and under pressure and then continue to advance the tool to inwardly extrude and size the part about the hole, (3) then further advance while also rotating the tool at a feed rate equal to the thread-forming pitch of the tool to thereby form a thread in the pierced hole, and (4) finally retract while also rotating the tool but in the reverse direction and at the same feed rate to release the tool from the threaded hole. The powered mechanism for performing these operations includes a linearly moveable shaft for holding the tool, a powered device for rotating the shaft, another powered device connected to the shaft by a lead screw connection having a thread pitch equal to that of a thread-forming portion of the tool, and a third powered device that is adapted to intercept and prevent shock loading on the tool from the piercing operation and thereby on the shaft from reaching the lead screw connection.

These and other aspects of the present invention will become more apparent from the accompanying drawings and the following description of exemplary embodiments of the invention.

DESCRIPTION OF EXEMPLARY EMBODIMENTS

Figure 1:
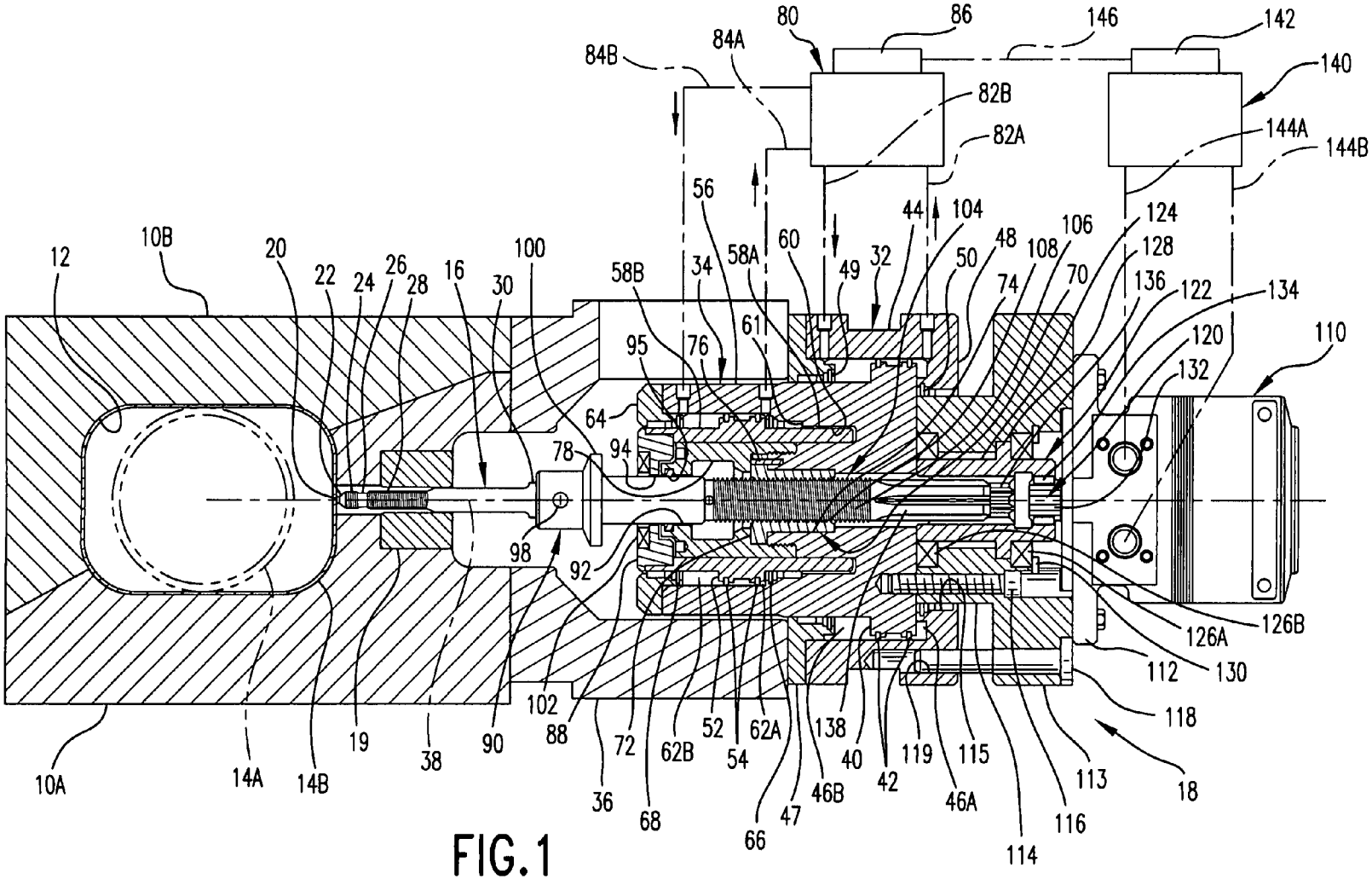
FIG. 1 is a partial side view mainly in section of hydroforming apparatus including a hydrotapping power unit according to the present invention wherein the power unit is shown holding a hydrotapping tool in a home position during the hydroforming of a part.

Referring to FIG. 1, there is shown a portion of a conventional hydroforming apparatus comprising a lower die 10A and upper die 10B that when closed as shown co-operatively form a die cavity 12 having a surface conforming to the required shape of the finished part. In the hydroforming process and in a conventional manner, a piece of tubular metal stock 14A as shown in phantom lines is captured between the dies in the die cavity and a hydroforming fluid (typically in the form of a water based liquid solution) is then delivered to the interior thereof through one end of the part while exit from the other end is blocked. With the hydroforming fluid thus delivered being raised to a pressure sufficient to forcibly expand the wall of the captured part outward against and conform to the cavity surface to thereby form a hydroformed part 14B having the required shape as shown in solid lines.

It will also be understood that following the formation of a threaded hole required in the hydroformed part as described below and also possibly the formation of one or more required holes in hydroformed part that could be accomplished simultaneously therewith, the hydroforming fluid that remains in the finished part is then exhausted. And also in a conventional manner through the above-mentioned other end to permit opening of the dies and removal of the finished part.

Further details of the type of hydroforming apparatus for which the present invention is suited are for example disclosed in U.S. Pat. No. 5,321,964 assigned to the assignee of this invention and which is hereby incorporated by reference. In addition, details of various types of apparatus for hydropiercing a required hole in a hydroformed part while remaining in the hydroforming dies are for example disclosed in U.S. Pat. Nos. 5,398,533 and 5,666,840 which are also assigned to the assignee of this invention and which are hereby also incorporated by reference.

The formation of a required threaded hole in the hydroformed part 14B, which can be performed simultaneously with the piercing of one or more required holes in the part, is provided by a singular tool 16 that is powered by a power unit 18 according to the present invention. The threaded hole required in the part 14B is in this example located in a side of the hydroformed part that is located in the lower die 10A. And a changeable die button or guide bushing 19 for the tool 16 is received in a stepped bore in the lower die 10A that extends through the die cavity surface and is centered on where the threaded hole is required in the part.

The tool 16 is like the tool embodiment disclosed in FIG. 11 of the aforementioned U.S. patent application Ser. No. 10/690,100 now U.S. Pat. No. 6,931,901 that is hereby incorporated by reference. The tool 16 is referred to therein as a hydrotapping tool and accordingly, the power unit 18 is referred to herein as a hydrotapping power unit as it is specially adapted to power such a tool. And it will also be understood that while only one of the tool embodiments is shown in the accompanying drawings, the other tool embodiments disclosed in the aforementioned U.S. patent application Ser. No. 10/690,100 now U.S. Pat. No. 6,931,901 have the same power requirements and can also be powered by the power unit 18 in a like manner to form a threaded hole in a hydroformed part while the part remains in the hydroforming dies.

In order to understand and fully appreciate the contributions of the hydrotapping power unit 18, it is necessary to understand the power requirements of the hydrotapping tool 16 which will now be described. The tool 16 is basically a one-piece tool having a hole-piercing end portion 20 at one end, an extruding portion 22 adjoining the end portion, a hole-sizing portion 24 adjoining the extruding portion, a relief portion 26 adjoining the hole-sizing portion, a thread-forming portion 28 adjoining the relief portion, and a tool-fastening portion 30 with a square cross-section at the other end of the tool.

The tool 16 must be initially positioned and held in the tool guide bushing 19 in the lower die 10A so that its piercing end is flush or at least only slightly retracted with respect to the immediately surrounding die cavity surface during the hydroforming of the part and is adapted on advancement of the tool in this bore to pierce and form a hole in the part without producing a separated slug and while the hydroforming pressure remains in the part to support this operation. The extruding portion 22 of the tool is in contrast adapted on continued tool advancement to enter the pierced hole and extrude an annular region of the wall of the part extending about the hole to a predetermined depth inward of the part while radially expanding the hole outward along its depth. And wherein the extruding operation by the tool is assisted with a flushing and lubricating action by the hydroforming fluid that is forced outward past the tool by the pressure remaining in the part after the piercing operation.

The hole-sizing portion 24 of the tool has a partial thread by which it is adapted on continued tool advancement to radially expand the extruded annular portion to enlarge the hole to a predetermined diameter suited to the subsequent formation of the required thread therein by material displacement as distinguished from metal removal with a thread cutting tap. Whereby the extruding and hole-sizing tool operations form an inwardly extending annular neck portion in the part defining the hole with a wall thickness substantially the same as the part but a depth dimension that is considerably larger than the wall thickness. And wherein this depth can be varied by the amount of extrusion to allow for a sufficient number of threads to be formed in the hole in order to securely hold a particular screw or a bolt.

The thread-forming portion 28 of the tool has a full thread that with the intervening relief portion 26 is an interrupted continuation of the partial thread that forms the hole-sizing portion 24 and has the same pitch but a relatively sharp edged crest and a larger major diameter than the partial thread portion 24. With the purpose of the relief portion 26 of the tool being to minimize the friction following the extruding operation for the starting of rotation of the tool to form the thread with the then immediately trailing thread-forming portion 28 of the tool. The full thread of the tool is by selection of a suitable conventional thread forming configuration adapted to form the required thread in the wall of the hole on continued tool advancement and now turning of the tool in the proper direction. Which in this case is a right-hand or clockwise direction as the required thread is a right-hand thread and therefore so are the tool threads. And in order to form the thread in the hole without a cutting action, the tool 16 must be fed at a feed rate equal to the pitch of the tool thread in the thread-forming portion 28 and in the proper rotational direction. On the other hand, the relief portion 26 is intended to enter the sized hole without tool rotation for the purpose of minimizing friction between the part and the tool following the hole-sizing operation and at the start of tool rotation to form the thread. With the result that there is efficiently produced a strong and precise thread in the extruded annular section of the hydroformed part by displacing or reorienting material rather than removing material as with a thread cutting tap.

Following the forming of the threaded hole in the part, the tool 16 must be retracted at the same feed rate while being rotated in the left-hand or counter-clockwise direction to free the tool from the thus formed threaded hole and allow the finished part to be removed from the dies. Wherein the hole-sizing portion 24 of the tool, because of its partial thread, does not wipe out the formed thread in the part as the tool is threadably backed out.

Describing now the hydrotapping power unit 18 and with reference to FIG. 1, the power unit is rigidly mounted on one side of the lower die 10A so as to locate and orient the tool 16 in aligned relationship with the tool guide bushing 19 that serves to accurately pilot the tool within this die. The power unit 18 comprises a pair of tandemly arranged powered devices 32 and 34 that in the exemplary embodiment are hydraulic cylinders having a common mounting base 36. Wherein the hydraulic cylinder 32 is of relatively large diameter and serves as a main or primary hydraulic cylinder in operating the tool 16 and the hydraulic cylinder 34 is of relatively small diameter and serves as a secondary hydraulic cylinder in the operation of the tool to resist the shock loading on the tool during the piercing operation. And wherein the mounting base 36 is bolted or otherwise fixed by suitable means to the lower die 10A so as to locate the centerline 38 of the hydraulic cylinders and that of the power unit in alignment with the tool guide bushing 19 and thus with the center of where the threaded hole is required in the part 14B.

The primary hydraulic cylinder 32 comprises a relatively large-diameter primary piston 40 with seals 42 that is received in a primary or main cylinder 44 that is bolted or otherwise fixed by suitable means to the mounting base 36. And wherein the primary piston 40 is operated by the selective supply of hydraulic fluid to and the exhaust of the fluid from chambers 46A and 46B at the opposite ends of the cylinder 44. Whereby the primary piston 40 is forced to move linearly along the centerline 38 between a fully retracted position and a fully advanced position. As determined by the primary piston 40 contacting at one end of cylinder 44 with an end cap 47 that closes this end of the cylinder and is held in position against the base 36 by this end of the cylinder 44 and by the piston contacting at the other end of the cylinder 44 with a radially inwardly located interior section of an integral end wall 48 of the cylinder 44 that closes this end of the cylinder. And wherein seals 49 and 50 are received in the respective end cap 47 and the end wall 48 and seal against associated members as later described to complete the sealing of the respective chambers 46B and 46A.

Furthermore and for the purpose of efficiently producing the force required to effect the piercing, extruding and hole-sizing operations by the tool 16, the primary piston 40 has a significantly greater area exposed to the chamber 46A than the area thereof exposed to the other chamber 46B. As a significantly greater force is required to advance the tool for these operations than is required to later retract the tool with the primary piston 40 following these tool operations.

The secondary hydraulic cylinder 34 comprises a relatively small-diameter secondary piston 52 with seals 54 that is received in a secondary cylinder 56 that is integral with the primary or main piston 44. The secondary piston 52 has an integral smaller diameter ring-shaped cylindrical portion 58A axially projecting from one end thereof and another cylindrical portion 58B of the same diameter projecting from the other end of the piston. The cylindrical portion 58A of the secondary piston 52 is slidably received and supported in an axially extending annular recess 60 in an interior wall 61 of the secondary cylinder 56 and the secondary piston 52 is operated by the selective supply of hydraulic fluid under pressure to and the exhaust of the fluid from chambers 62A and 62B at opposite ends of the cylinder 56. Whereby the secondary piston 52 is forced to move linearly along the centerline 38 between a fully retracted position and a fully advanced position as determined by the piston contacting with the ends of the secondary cylinder 56. Wherein a secondary cylinder end cap 64 that is press-fitted or other wise suitably fixed in one end of the cylinder 56 forms one of these ends and the interior wall of the cylinder 56 at a location radially outward of the annular recess 60 forms the other end. And wherein seals 66 and 68 at opposite ends of the secondary cylinder 56 seal against the respective cylindrical portions 58A and 58B of the secondary piston to complete the sealing of the respective chambers 62A and 62B.

A changeable lead screw nut 70 with an integral radially outwardly extend collar 72 at an outer end thereof is received in a centrally located stepped bore 74 in the secondary cylinder 56 and primary piston 40. A pin 76 that is press fitted or otherwise suitably fixed in the step of the counter bore 74 is received in a hole in the collar 72 to thereby prevent relative rotation between the lead screw nut 70 and the secondary cylinder 56 and primary piston 40. And the lead screw nut 70 is retained in place by an assembly nut 78 that is received in the interior of the secondary piston 52 and is threaded to the secondary cylinder 44 and primary piston 40 at a location radially outward of the collar 72.

The hydraulic cylinders 32 and 34 are controlled by a hydraulic control system 80 of a suitable conventional type. Wherein the control system 80 is connected by flexible hydraulic lines 82A and 82B to the respective chambers 46A and 46B of the stationary primary hydraulic cylinder 32 and by flexible hydraulic lines 84A and 84B to the respective chambers 62A and 62B of the moveable secondary hydraulic cylinder 34. And wherein the hydraulic control system 80 includes a programmable controller 86 that is programmed to operate the hydraulic cylinders and thereby the tool 16 as described in detail later.

A secondary piston end cap 88 is press-fitted or otherwise suitably fixed in the outer end of portion 58B of the secondary piston 52. And a changeable center shaft 90 for holding and directly operating the tool 16 extends outwardly of the power unit from the lead screw nut 70 through a central bore 92 in the assembly nut 78 and a central bore 94 in the secondary piston end cap 88 and extends in the opposite direction from the lead screw nut 70 through the bore 74 in the secondary cylinder 56 and primary piston 40.

The shaft 90 is supported at one end of the power unit for both rotary and linear movement by the bores 92 and 94 in the respective assembly nut 78 and secondary piston end cap 88. And a wiper 95 that is received in an annular recess in the assembly nut bore 92 wipes the center shaft 90 during relative movement of the shaft. The center shaft 90 where it projects outwardly of the secondary piston end cap 88 has a relatively large diameter end portion having a socket that closely receives the square-shaped section of the fastening end 30 of the tool. With the tool held firmly there in place by a setscrew 98 or other suitable fastener.

The projecting portion of the center shaft 90 between this end of the center shaft and the secondary piston end cap 88 is also provided with an integral shoulder 100 that is operatively engaged by the secondary piston 52 by the secondary piston end cap 88 acting through a thrust bearing 102 to engage the shoulder. Wherein the thrust bearing 102 is received with clearance about the center shaft 90 and is mounted in a counter-bore in the outer end of he secondary piston end cap 88.

The primary piston 40 and secondary cylinder 56 and thus the lead screw nut 70 are prevented from rotation as described in detail later and the center shaft 90 is provided at an intermediate location between its shoulder 100 and its other end with a lead screw connection 104 connecting the center shaft with both the primary piston 40 and secondary cylinder 56 which are integrally joined together. The lead screw connection 104 includes the lead screw nut 70 and further comprises an external thread 106 on the center shaft 90 that is in continuous engagement with a centrally located threaded hole 108 in the lead screw nut 70. And because the lead screw nut 70 is prevented from rotation while being connected to move conjointly with the primary piston 40 and secondary cylinder 56, the center shaft 90 is moved linearly and conjointly with the secondary cylinder 56 and the primary piston 40 by operation of the primary piston 40. And alternatively, the center shaft 90 is moved linearly independently of the secondary cylinder 56 and the primary piston 40 by rotation of the center shaft 90.

The required feed rate to be imparted by the center shaft 90 to the tool 16 for both forming the required thread and then retracting the tool from the formed thread can thus be effected by the lead screw connection 104 regardless of the rotational speed at which the center shaft is driven as described later. And wherein this is accomplished by providing the lead screw connection 104 with a thread pitch equal to that of the partial thread and full thread of the tool 16.

In addition to being selectively operated by the hydraulic cylinders 32 and 34, the center shaft 90 is also selectively operated by a third powered device 110 that in the exemplary embodiment is a hydraulic motor of a suitable conventional type wherein the centerline of the motor is aligned with the centerline 38 of the power unit. The hydraulic motor 110 has a mounting base 112 that is bolted or other wise suitably fixed to a support member 113 for the motor. The motor support member 113 has a cylindrical portion 114 that is received in a centrally located stepped bore 115 in the integral end wall 48 of the primary cylinder 44. And the motor support member 113 is fixed to the outboard end of the primary piston 40 by bolts 116 (only one of which is shown) that extend through the cylindrical portion 114 of the motor support member. Whereby the hydraulic motor 110 is physically connected to move conjointly with the primary piston 40 and the secondary cylinder 56. And wherein the seal 50 for the chamber 46A seals against the cylindrical portion 114 of the relatively moveable motor support member 113 to seal the chamber 46A of the primary hydraulic cylinder 32 at the sliding juncture of the motor support member 113 with the primary cylinder 44.

The hydraulic motor 110 and the primary piston 40 and the secondary cylinder 56 and thus the lead screw nut 70 are prevented from rotation by one or more anti-rotation pins 118 (only one of which is shown). Wherein each of the pins 116 is press-fitted in as shown or otherwise suitably fixed to the motor supporting member 113, is radially outwardly spaced from and extends parallel to the centerline 38 of the power unit, and is slidably received in a bore 119 in the primary cylinder 44 that is fixed to the power unit mounting base 36.

The hydraulic motor 110 has an output shaft 120 projecting into the motor support member 113 and the center shaft 90 extends outwardly past the primary piston 40 and also into the support member 113 for connection at this end of the center shaft with the motor output shaft. The motor output shaft 120 is drivingly connected to this end of the center shaft 90 by a coupling device 122 comprising a cylindrical coupling member 124 that is rotatably supported at its outer peripheral ends in the support member 113 by anti-friction bearings 126A and 126B mounted in counter-bores in the ends of the support member 113. Wherein the coupling member 124 is axially fixed in position in the motor support member 113 by an integral, radially outwardly extending collar 128 on the coupling member that is received in the counter-bore in the outboard end of the motor support member where it together with the bearing 126A are retained by a retaining ring 130. While the other bearing 126B supporting the coupling member 124 is retained in place by being sandwiched by the outboard end of the primary piston 40 and the inboard end of the coupling member.

The motor output shaft 120 has external splines 132 that are received by a first set of internal splines 134 in the coupling member 124. And the coupling member 124 has a second set of internal splines 136 that are axially spaced from the first set of internal splines 134 and are engaged with external splines 138 on this end of the center shaft 90. The splines 136 and 138 are substantially longer than the other internal splines 134 in the coupling member and permit the center shaft 90 to move axially relative to the motor output shaft 120 while remaining engaged as will be further described later.

The hydraulic motor 110 on rotating its output shaft 120 in either direction is thus connected by the coupling device 122 to conjointly rotate the center shaft 90 in the same direction. Whereupon the center shaft 90 and thus the tool 16 is either advanced toward or retracted from the part through operation of the lead screw connection 104 depending on which direction the motor output shaft is being powered. Alternatively, when the hydraulic motor 110 is not driving the center shaft 90 and the hydraulic cylinder 32 is operated to advance or retract the center shaft 90 thought co-operation with the lead screw connection 104, the hydraulic motor 110 is also physically and conjointly advanced or retracted therewith because of the connection of the motor mounting base 112 to the primary piston 40.

The motor 110 has a hydraulic control system 140 including a programmable controller 142. Wherein the control system 140 is connected by flexible hydraulic lines 144A and 144B to the moveable motor and the motor controller 142 is programmed to operate the motor 110 to drive the center shaft 90 and thereby the tool 16 as described in detail later. And wherein the hydraulic motor controller 142 is connected by a communication link 146 with the hydraulic system controller 86 for the hydraulic cylinders 32 and 34 so that the two control systems 80 and 140 are coordinated to operate in conjunction with each other to power the tool with both the hydraulic cylinders 32 and 34 and the hydraulic motor 110 in the proper sequence in forming a threaded hole in the part with the tool 16 and then retracting the tool there from as described below.

Describing now the operation of the hydrotapping power unit 18 in the forming of a required threaded hole in the hydroformed part 14B, the primary piston 40, secondary piston 52, and the center shaft 90 are positioned as shown in FIG. 1 prior to the hydroforming of the part. Wherein the pistons 40 and 52 have been fully retracted by their respective hydraulic cylinders 32 and 34 by supplying hydraulic fluid under pressure to their respective chambers 46B and 62B while exhausting their respective chambers 46A and 62A as shown by the directional flow arrows. And the hydraulic motor 110 has through rotation of its output shaft 120 and through operation of the lead screw connection 104 positioned the tool 16 within the tool guide bushing 19 in the lower die 10A in what will be referred to as its home position. Where the hydraulic motor 110 now stands idle and the piercing end of the tool 16 is located flush or is slightly retracted with respect to the surrounding die cavity surface for the hydroforming of the part.

Figure 2:
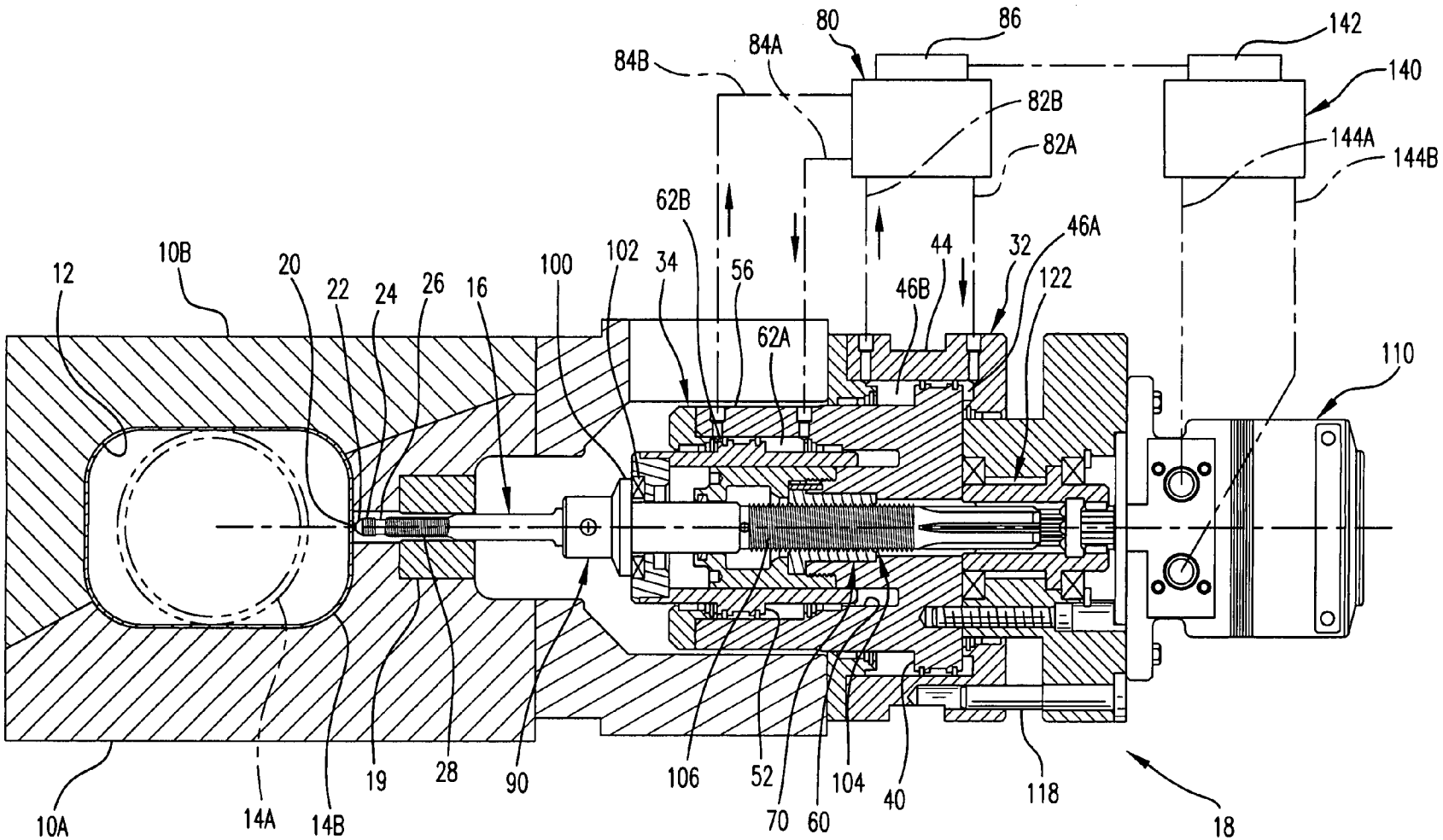
FIG. 2 is a view like FIG. 1 but showing the manner in which the power unit holds the tool prior to piercing the part.

Immediately following the completion of the hydroforming of the part and while the hydroforming pressure is maintained in the part and while the hydraulic motor still remains idle, the secondary piston 52 is advanced by the secondary hydraulic cylinder 32 as shown in FIG. 2 by then supplying hydraulic fluid under pressure to the chamber 62A and exhausting chamber 62B as shown by the directional flow arrows. And wherein such advancement of the secondary piston 52 is caused to occur at a slow speed with slow pressure buildup in the chamber 62A to a certain pressure as described later in connection with the piercing operation. And wherein with the full advancing stroke of the secondary piston 52 as shown in FIG. 2, the secondary piston 52 operating through the thrust bearing 102 engages the shoulder 100 on the center shaft 90 but does not force advancement of the center shaft 90 and thereby the tool 16 from its home position toward the part. Moreover, this operation pre-loads the lead screw connection 104 to thereby assist in relieving the lead screw connection of the shock load resulting from the subsequent piercing operation as will now be described.

Figure 3:
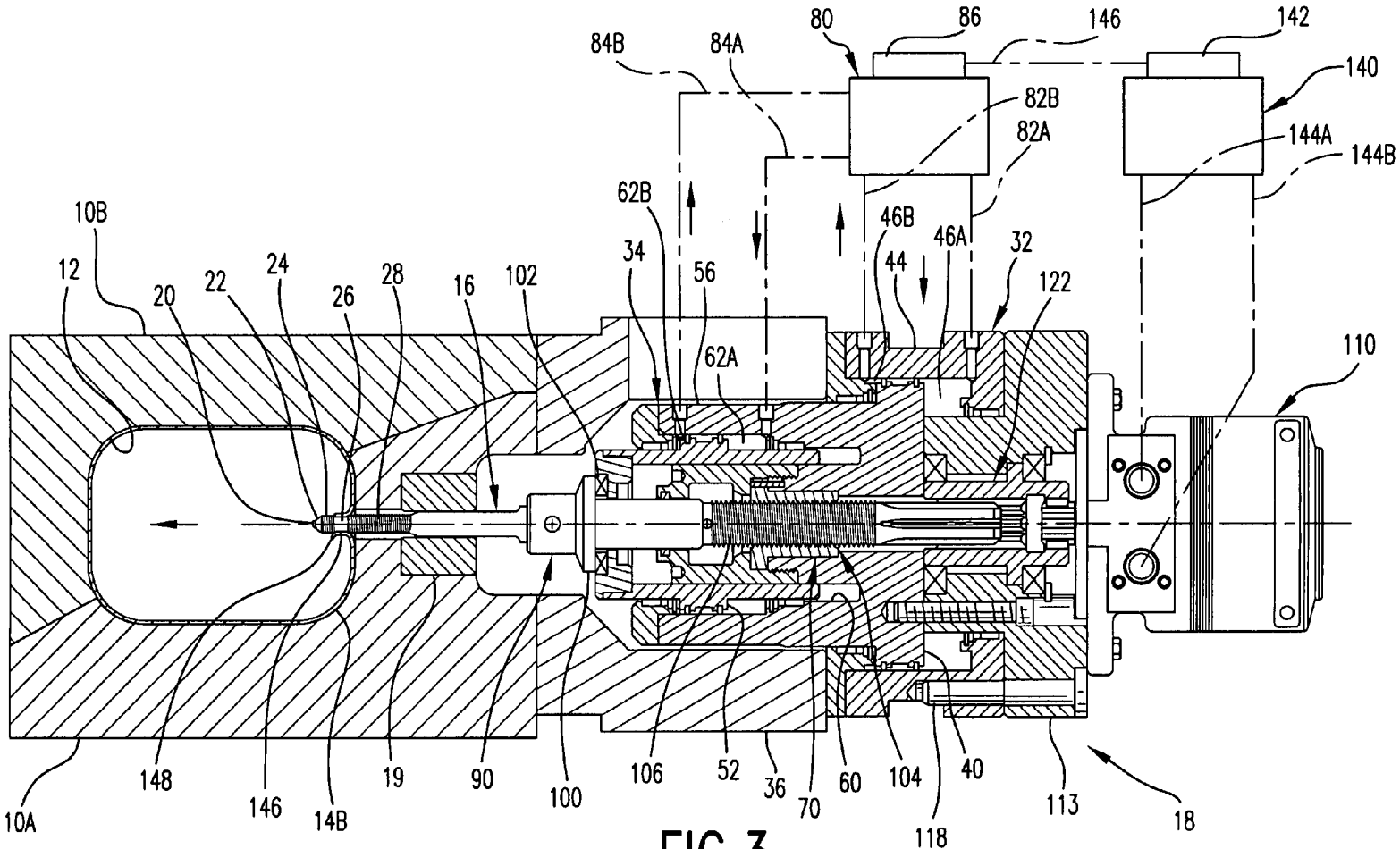
FIG. 3 is a view like FIG. 2 but showing the power unit advancing the tool to pierce a hole in the part and then extrude the part inwardly about the hole and size the hole.

Following the hydroforming of the part 14B and referring to FIG. 3, the primary hydraulic cylinder 32 is then operated to advance the center shaft 90 and thereby the tool 16 through the engagement of the thrust bearing 102 with the shoulder 100 on the center shaft while the secondary piston 52 remains advanced in the secondary cylinder 56 and the hydraulic motor 110 still remains idle. Wherein in this operation, hydraulic fluid under pressure is now supplied to the chamber 46A of the primary hydraulic cylinder 32 while the chamber 46B is exhausted as shown by the directional flow arrows to advance the primary piston 40 and thereby the tool 16 and also the hydraulic motor 110 because of the connection of the motor to the primary piston. And because the secondary cylinder 56 is joined to the primary piston 40, the secondary piston 52 also moves conjointly with the primary piston 40 and through engagement of the thrust bearing 102 with the shoulder 100 on the center shaft 90 thus forcibly advances the tool 16 toward the part.

With such advancement of the tool 16 by the power unit 18, the hole-piercing end portion 20 of the tool is caused to pierce the part. And with such piercing, there will occur an instantaneous shock load on the tool that results from the hydroforming pressure then acting on the tool as well as the shock from the shearing of the metal that also acts on the tool. This shock load is however prevented by the secondary piston 52 through engagement of the thrust bearing 102 with the shoulder 100 on the center shaft 90 from being transmitted back through the center shaft to the lead screw connection 104 with the potential for shortening the useful life of the latter. With the pressure buildup in the chamber 62A of the secondary hydraulic cylinder 32 acting on the secondary piston 52 prior to this piecing operating being predetermined to fully resist the anticipated shock load at the intervening shoulder 100 of the center shaft 90 and thus in an intercepting manner prior to reaching the lead screw connection 104. With the pressure necessary for such shock resistance determined for example by conducting trials in the setup of the power unit 18 prior to a production run.

Following the piercing of a hole in the part and referring to FIG. 3, the tool 16 continues to be advanced by the primary piston 40 acting through the lead screw connection 104 whereby the extruding portion 22 and then the sizing portion 24 of the tool has entered the pierced hole and wherein the relief portion 26 has eventually entered the pierced hole which occurs at the completion of the full advancing stroke of the primary piston 40 as shown in FIG. 3. And wherein the secondary piston 52 and also the hydraulic motor 110 have continued to advance with the center shaft 90 and the tool 16.

In this phase of tool operation, the tool 16 is not rotated and the hydroforming pressure supports the wall of the part against collapsing and distorting during the piercing operation at least until the pressure drops significantly at the point where the wall is actually pierced through. And with it being understood that the wall of the part is sufficiently strong because of its thickness and/or type of material or the piercing end of the tool is of sufficient area to prevent premature piercing of the wall by the hydroforming pressure forcing the wall outward against the tool during the hydroforming of the part. Also in this phase of tool operation, the extruding portion 22 of the tool 16 is adapted with such continued advancement by the primary piston 40 to enter the pierced hole and by extrusion form an inwardly extending internal tubular neck portion 146 defining a thus expanded and substantially deepened hole in the part prior to the hole-sizing tool portion 24 entering the hole to size it to the proper diameter for thread forming as distinguished from thread cutting.

The piercing end portion 20 of the tool at the end of the piercing operation produces one or more appendages 148 that remain integral with the inner edge of the neck portion 146. Wherein the number of such appendages depends on the shape of the piercing end of the tool as disclosed in the afore-mentioned U.S. patent application Ser. No. 10/690,100 now U.S. Pat. No. 6,931,901. With only one such appendage as shown occurring in this example as a result of using the exemplary tool 16. And it will also be understood that the configurations of the respective hole piercing end portion 20 and extruding portion 22 of the tool 16 are determined dimensional wise for a particular application so as to pierce and extrude the wall of the part inwardly to the extent necessary to form the wall of the hole in the neck portion 146 with a depth or axial extent that allows the formation therein of the number of threads required to adequately secure a particular screw or bolt or male threaded part.

When the wall of the part is initially pierced in the hydropiercing operation by the piercing end portion 20 of the tool, there will typically occur a sudden drop in the hydroforming pressure within the part following the shock load delivered to the tool. This pressure drop may for example be 80% of the forming pressure but it has been found that the remaining 20% is sufficient to force the hydroforming fluid to advantageously both flush and lubricate the extruding tool portion 22 to thus facilitate its extruding operation as it proceeds to advance into the pierced hole and inwardly extrude the wall of the part about the pierced hole.

Figure 4:
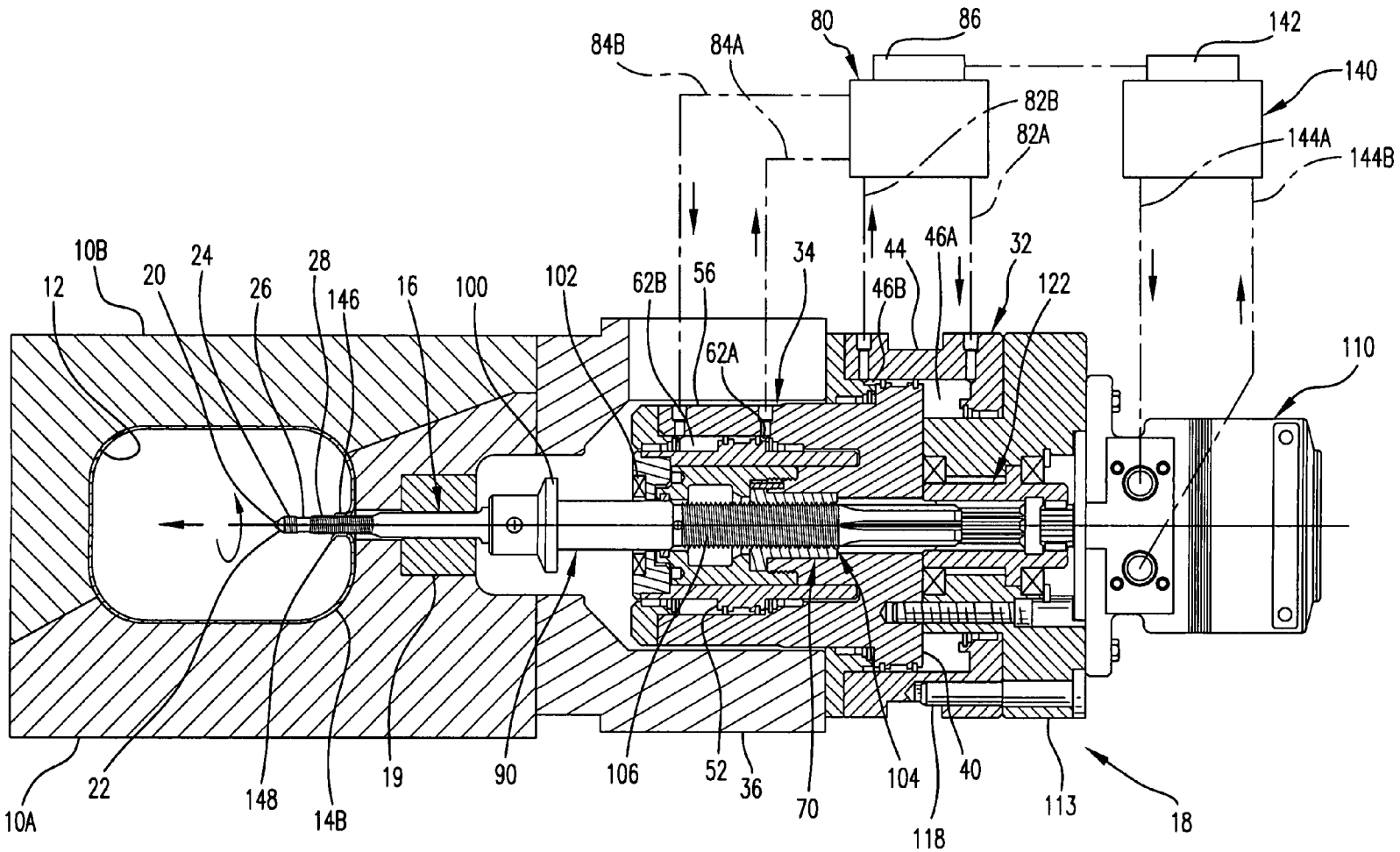
FIG. 4 is a view like FIG. 3 but showing the power unit feeding the tool to form a thread in the hole.

At the end of this phase of tool operation which has occurred without tool rotation and with the relief portion 26 having entered the hole, the primary piston 40 remains in its advanced position and the secondary piston 52 is then retracted as shown in FIG. 4 by exhausting the chamber 62A and supplying hydraulic fluid under pressure to the chamber 62B as shown by the directional flow arrows. The hydraulic motor 110 is then operated to rotate the center shaft 90 in the right-hand or clockwise direction by the directing of hydraulic fluid under pressure with respect to the motor via the hydraulic lines 144A and 144B as shown by the directional flow arrows. Whereby the center shaft 90 is driven by the hydraulic motor 110 through the coupling device 122 and the tool 16 is now further advanced and rotated at a feed rate equal to the thread pitch of the tool threads because of the lead screw connection 104 between the center shaft 90 and the non-rotatable primary piston 40 and secondary cylinder 56 having the same thread pitch as the tool. And wherein the initial rotation of the tool 16 is caused to occur with minimized friction in the part following the hole-sizing operation because the relief portion 26 of the tool is then located in the hole and has a smooth annular surface whose maximum diameter is less than that of the sized hole. And wherein the coupling device 122 permits relative linear movement between the center shaft 90 and the hydraulic motor 110 while maintaining a drive connection there between.

The hydraulic motor 110 continues to thus power the center shaft 90 and thereby form the required thread with the thread-forming portion 28 of the tool 16 as shown in FIG. 4. Wherein the lead screw connection 104 has fed the tool with such motor operation at the required feed rate to form the thread by material displacement instead of a thread cutting operation. And wherein the full thread portion 28 of the tool displaces most of the material (approximately 95%) to the inside of the groove or crevice of this thread in forming the thread in the wall of the part. With the small remainder of material being displaced outward but not enough to make a significant difference in the outer surface of the hole defining tubular neck portion 146.

Moreover, the thread is thus formed regardless of the speed of the hydraulic motor 110 which only controls the time required of this operation and which can be minimized to reduce cycle time by determining the optimum fastest motor speed that will continue to produce a quality formed thread in the part. This information can for example be obtained in trials when setting up the hydrotapping power unit 18 prior to a production run and by then instructing the hydraulic motor controller 142 to control the motor hydraulic system 140 to perform accordingly.

Figure 5:
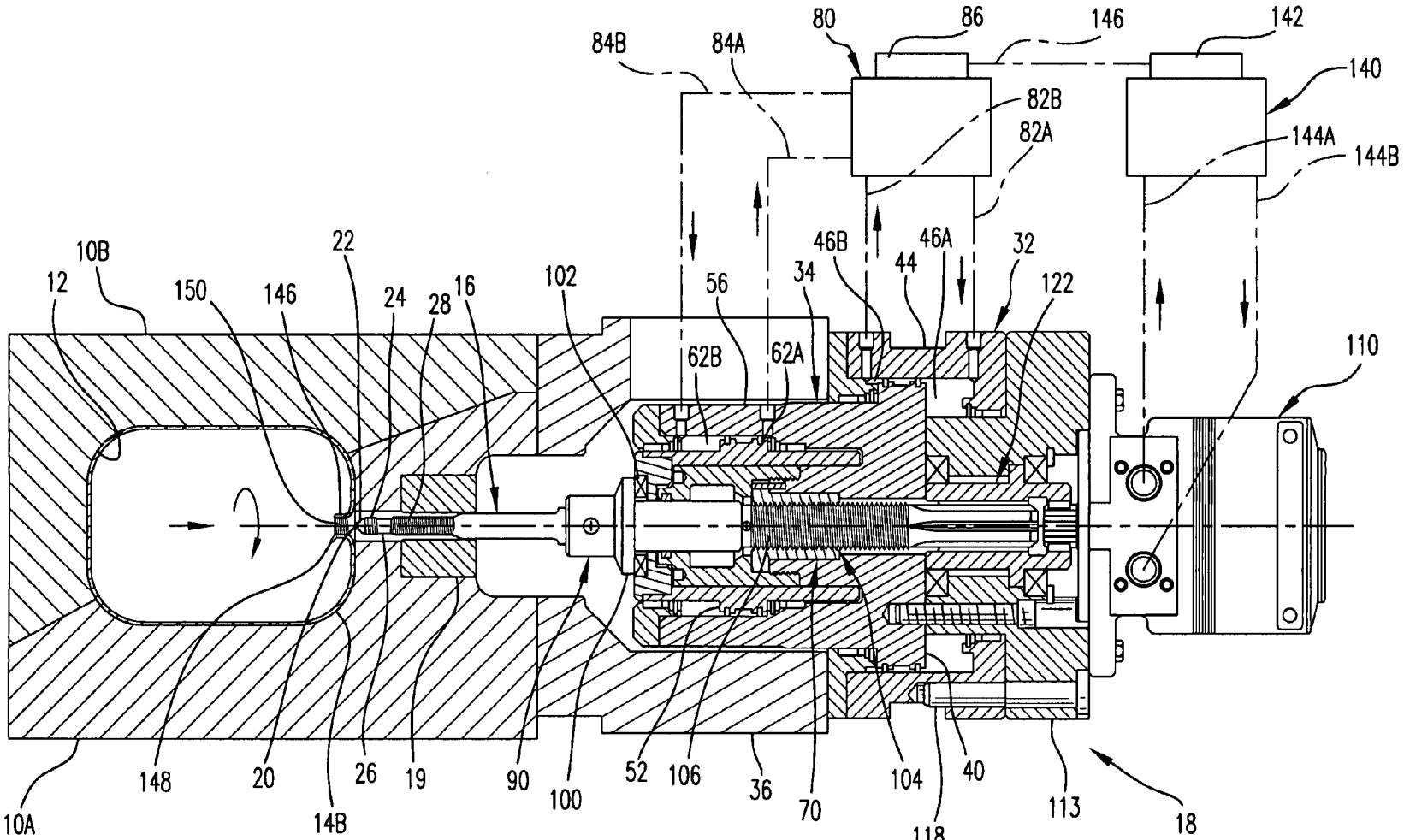
FIG. 5 is a view like FIG. 4 but showing the power unit feeding the tool away from the formed thread.

Following the formation of the thread with the full thread portion 28 of the tool 16 and while the primary piston 40 remains in its advanced position and the secondary piston 52 remains in its retracted position, the tool 16 is then retracted from or backed out of the thus formed thread 150 as shown in FIG. 5. By the hydraulic motor 110 now rotating the center shaft 90 and thereby the tool 16 in the left-hand or counterclockwise direction by the directing of hydraulic fluid under pressure with respect to the motor via the hydraulic lines 144A and 144B as shown by the directional flow arrows. Whereby the tool 16 is retracted by operation of the lead screw connection 104 at the same feed rate used to form the thread 150 but now in the opposite direction and wherein the coupling device 122 again permits such linear center shaft movement with respect to the motor 110. And whereby the partial thread portion 24 of the tool then follows the full thread portion 28 of the tool and because of it being only a partial thread, the then trailing partial thread portion 24 passes freely through and does not wipe the crest off the formed thread. And with the center shaft 90 at the conclusion of this phase of operation then in it's maximum retracted position with respect to the motor 110 as shown in FIG. 5. And again the cycle time for this operation can be minimized by operating the hydraulic motor 110 at the optimum highest speed while retaining a quality formed thread and per instructions to the hydraulic motor controller 142.

Figure 6:
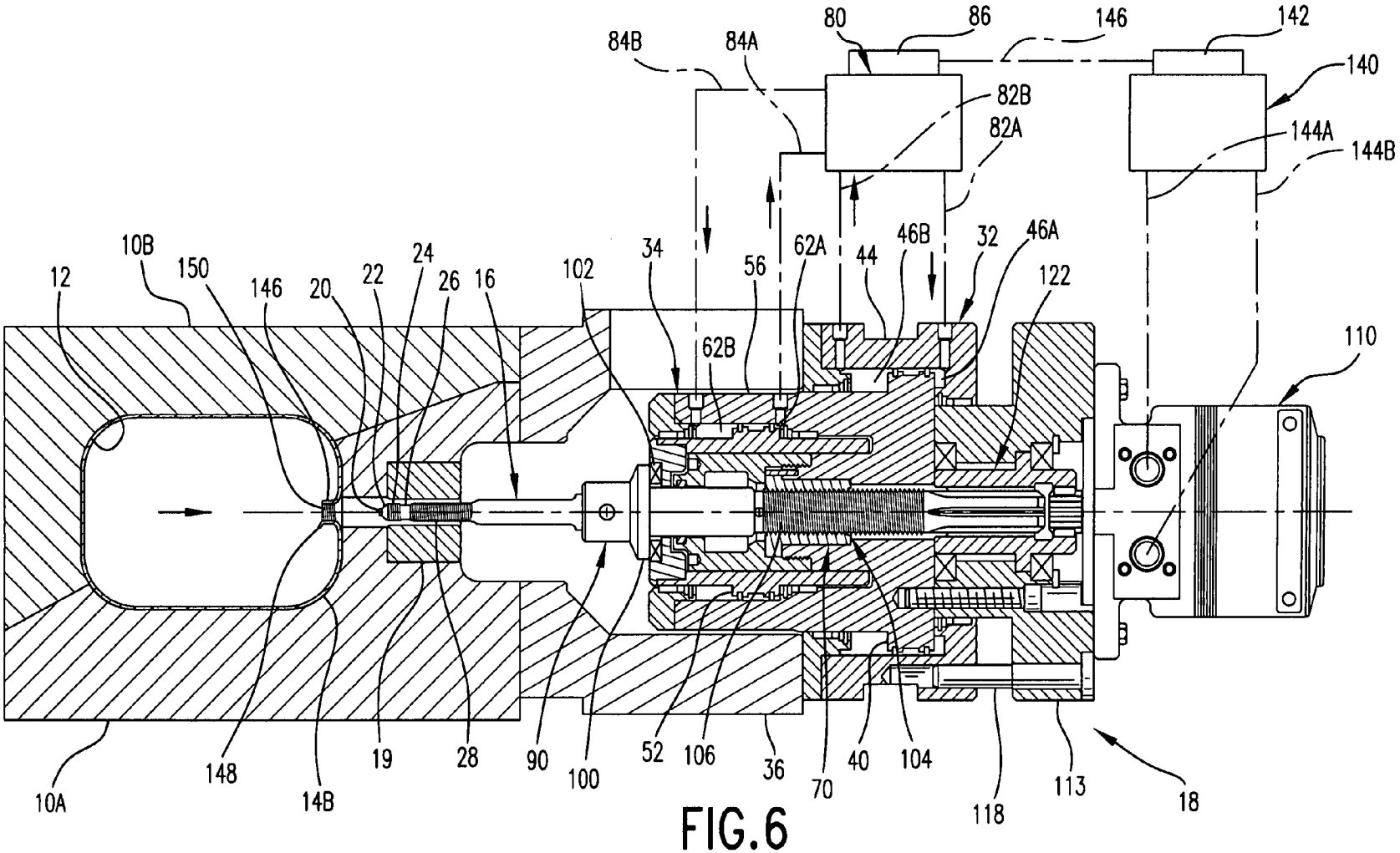
FIG. 6 is a view like FIG. 5 but showing the power unit conditioned for return of the tool to its home position.

On exiting the thus formed threaded hole and now referring to FIG. 6, the operation of the hydraulic motor 110 is ceased. And the tool 16 is then further retracted by the primary piston 40 by again supplying hydraulic fluid under pressure to chamber 46B and exhausting chamber 46A in the primary hydraulic cylinder 32 as shown by the directional flow arrows. Whereby the secondary hydraulic cylinder 34 (secondary cylinder 56 and secondary piston 52) is conjointly retracted with the primary piston 40, the center shaft 90 with the tool 16 is also conjointly retracted therewith because of the lead screw connection 104 between the center shaft and the primary piston, and the hydraulic motor 110 is also conjointly retracted therewith because of its direct mounting to the primary piston. Resulting in the power unit being conditioned as shown in FIG. 6. Wherein the shoulder 100 on the center shaft 90 has remained in abutment with the thrust bearing 102 at the outboard end of the secondary piston 52 while the center shaft 90 remains in its maximum retracted position with respect to the motor 110.

Figure 7:
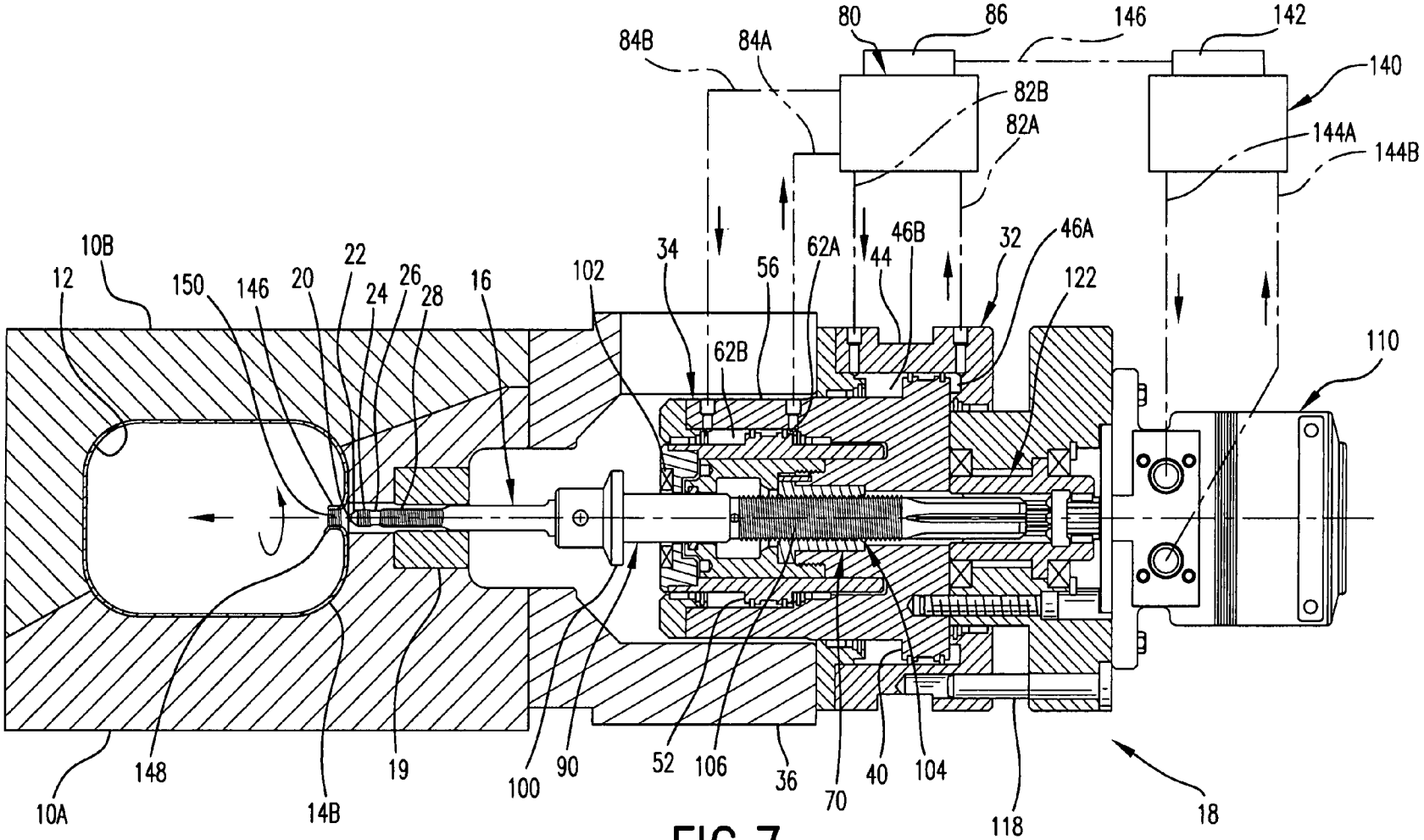
FIG. 7 is a view like FIG. 6 but showing the power unit having returned the tool to its home position in preparation for the processing of another part.

Then in the final phase of operation of the power unit 18 as shown in FIG. 7 and in preparation for forming a threaded hole in another part, the hydraulic motor 110 is again rotated in the right-hand or clockwise direction by the directing of hydraulic fluid under pressure with respect to the motor via the hydraulic lines 144A and 144B as shown by the directional flow arrows. And through operation of the lead screw connection 104 returns the tool 16 to its home position in preparation for the processing of another part.

Following the formation of the part 14B with the required threaded hole, the part is exhausted of any remaining hydroforming fluid pressure in a conventional manner. And the dies are then opened and the part is removed to clear the dies for the processing of another part.

As to the threaded configuration of the tool 16 and the feed rate imparted to the tool by the hydrotapping power unit 18 as described above and in relation to a certain required threaded hole, the required thread may for example be an 8×1.25 mm right-hand thread. In that case, (A) the hole-piercing end portion 20, extruding portion 22 and the hole-sizing expanding portion 24 of the tool are dimensioned accordingly to form the desired dimensions for the resulting tubular neck portion 146, (B) the full thread 28 is formed with the required thread forming configuration for an 8×1.25 mm right-hand thread, (C) the partial thread portion 24 is provided with the same pitch but with a major diameter at its helical crest that is substantially smaller than the major diameter of the full thread portion 28 such that the partial thread can freely return through a 8×1.25 mm right-hand thread, (D) the relief portion 26 of the tool is provided with a maximum diameter less than the minor diameter of the 8×1.25 mm thread, and (E) the lead screw connection 104 is provided with the same thread pitch as the partial thread and full thread of the tool; namely a 8×1.25 mm right-hand thread in order to provide the required tool feed rate for forming the thread and also releasing there from without disturbing the formed thread. And wherein it will be understood that for each application of the power unit with a particular hydroforming tapping tool, a center shaft 90 and a lead screw nut 70 having the required thread pitch are used that match the thread of the tool and may be selected from a stock of corresponding interchangeable parts having a range of thread pitches.

In further regard to the control of the three powered devices 32, 34 and 110 in performing the above described operations, the controllers 86 and 142 can be programmed to operate the respective hydraulic control systems 80 and 140 by simply encoding the motor controller 142 to count output shaft revolutions and detecting the real time position of the center shaft 90 with a linear position transducer or a set of proximity switches associated with the center shaft. It will also be appreciated that the speed of linear movement of the center shaft 90 effected by operation of the primary piston 40 of the primary hydraulic cylinder 32 and that of the secondary piston 52 by operation of the secondary hydraulic cylinder 34 can be adjusted with the controller 86. And can for example be made significantly faster than the linear feed rate for forming the thread and extracting the tool from the threaded hole. And as a result minimize the total cycle time of the power unit 18 in forming the threaded hole and releasing there from. Such optimum piston speeds can for example be determined during the setup of the hydrotapping power unit before a production run. Wherein the speed of the hydraulic cylinder operations can be adjusted through instructions to the controller 86 for the hydraulic cylinder control system 80 based on such trials in order to obtain the fastest optimum time necessary to complete their operations.

It will also be understood that while the above-described sequence of power unit operations is one presently preferred manner of operation, the power unit is also capable of being operated in a different manner to obtain certain other advantages. For example, the secondary piston 52 can be advanced to hold the center shaft 90 and thereby the tool 16 in its home position during the hydroforming of the part as well as during the subsequent piercing operation. With the accompanying advantage of relieving the lead screw connection 104 of this task as well as later absorbing the shock loading on the tool during the subsequent piercing operation to relieve the lead screw connection of having to resist the shock load on the tool.

Moreover, it will be appreciated that the mounting of the hydraulic motor 110 to the primary piston 40 serves to minimize the overall axial length of the hydrotapping power unit 18. And this is especially advantageous in that without such space savings, there may not be sufficient space available in a particular hydroforming apparatus application to allow installation of a hydrotapping power unit of longer length.

For example, the hydroforming dies may, within the physical constraints of the press for the hydroforming dies, be made to process two or more parts at a time in order to reduce cycle time as well as gain other cost improvements. And a suitable power unit for each hydrotapping tool would then be required for each part that requires a threaded hole provided the hydrotapping power units will fit within the press constraints. And with the short axial length of the hydrotapping power unit 18 according to the present invention it has been found this allows their multiple installations in such an application where power units with a motor that is not so mounted would not.

Another example is where the short axial length of the hydrotapping power unit according to the present invention permits there use in hydroforming apparatus having a rolling bolster that moves the hydroforming dies into and out of the press. Where other type power units without a motor so mounted would find interference by the press columns because of their greater length.

Another advantage that results from the short length of the hydrotapping power unit of the present invention is in the case of where the hydrotapping power unit must be mounted vertically on either the upper or lower die. And again the hydrotapping power unit of the present invention can permit such an installation. Where a hydrotapping power unit without such a motor mounting would not because of interference in the press and require increasing the opening or shunt height of the press and result in increased cycle time. Or if no further adjustment in the press is possible, either require increasing the physical dimensions of the press which would be costly or require resorting to secondary operations outside the dies in order to form a required threaded hole in the part.

Having disclosed the presently preferred exemplary embodiments, various forms of the hydrotapping power unit according to the present invention are likely to result from such disclosure to those skilled in this art. Therefore, the invention is to be limited only by the scope of the appended claims.

What is claimed is:

1. A hydrotapping power unit for powering a hydrotapping tool comprising a shaft adapted to advance and retract the tool with respect to a part while the part is contained in a hydroforming die cavity, a first powered device, a lead screw connection operatively connecting said first powered device and said shaft having a thread pitch equal to that of a thread-forming portion of the tool, a second powered device drivingly connected to said shaft and adapted to rotate said shaft in a forward direction and in cooperation with said lead screw connection advance said shaft and thereby the tool to a home position where a piercing end of the tool is located at least substantially flush with the die cavity during hydroforming of the part, said first powered device adapted to cooperate with said lead screw connection to further advance said shaft and thereby force the piercing end of the tool to pierce a hole in the part while hydroforming pressure is maintained in the part and thereafter continue to advance said shaft causing an extruding portion of the tool to enter the hole and inwardly extrude the part about the hole, a third powered device adapted to prevent shock loading on the tool during the piercing operation from reaching said lead screw connection, said second powered device operable to again rotate said shaft in said forward direction and in cooperation with said lead screw connection further advance the tool and thereby form a thread in the hole with the thread-forming portion of the tool, and said second powered device operable to rotate said shaft in a reverse direction and in cooperation with said lead screw connection retract the tool from the threaded hole at the same said feed rate.

2. A hydrotapping power unit as set forth in claim 1 wherein said first and third powered devices are hydraulic cylinders and said second powered device is a hydraulic motor.

3. A hydrotapping power unit as set forth in claim 1 wherein said third powered device includes a thrust bearing and a hydraulically operated piston adapted to engage said thrust bearing with said shaft so as to intercept the shock loading before reaching said lead screw connection.

4. A hydrotapping power unit as set forth in claim 1 wherein said first powered device is a hydraulically operated device comprising a stationary primary cylinder and a primary piston received in said primary cylinder, said third powered device is a hydraulically operated device comprising a secondary cylinder joined to said primary piston and a secondary piston received in said secondary cylinder adapted to operatively engage said shaft so as to intercept the shock loading before reaching said lead screw connection, said second powered device is a hydraulically operated motor mounted on said primary piston, an anti-rotation device prevents rotation of said primary piston and said secondary cylinder and said motor relative to said primary cylinder, and said lead screw connection connects said shaft to said primary piston and said secondary cylinder.

5. A hydrotapping power unit as set forth in claim 4 wherein said primary piston is adapted to act in cooperation with said lead screw connection to hold the tool in said home position during hydroforming of the part.

6. A hydrotapping power unit as set forth in claim 4 wherein said secondary piston is adapted to hold the tool in said home position during hydroforming of the part.

7. A hydrotapping power unit as set forth in claim 4 wherein a coupling device maintains a drive connection between said motor and said shaft throughout linear movement of said shaft with respect to said motor.

8. A hydrotapping power unit as set forth in claim 4 wherein said anti-rotation device comprises at least one pin adapted to prevent relative rotation between said motor and said primary cylinder and thereby prevent rotation of said primary piston and said secondary cylinder while permitting conjoint linear movement of said motor and said primary piston and said secondary cylinder.

9. A hydrotapping power unit as set forth in claim 1 wherein said first powered device is adapted to also advance a partial thread/hole-sizing portion of the tool and then a relief portion of the tool into the pierced hole, and said second powered device is adapted to start forward rotation of said shaft while the relief portion of the tool is in the pierced hole.

10. A hydrotapping power unit as set forth in claim 1 wherein said first powered device is a hydraulically operated device comprising a stationary primary cylinder and a primary piston received in said primary cylinder and connected by said lead screw connection to said shaft, said second powered device is a hydraulic motor adapted to move conjointly with said primary piston, and said third powered device is a hydraulically operated device comprising a secondary cylinder joined to said primary piston and a secondary piston received in said secondary cylinder and a thrust bearing received about said shaft wherein said secondary piston is adapted to engage said thrust bearing with said shaft to thereby intercept the shock loading before reaching said lead screw connection.

11. A hydrotapping power unit as set forth in claim 1 wherein said powered devices and said shaft have a common centerline.

12. A hydrotapping power unit as set forth in claim 1 wherein said powered devices are adapted to be operated at various speeds of operation.

* * * * *